United States Patent [19]

Walker, Jr.

[11] 4,308,951

[45] Jan. 5, 1982

[54] COLLAPSIBLE BOOK SUPPORT AND ORGANIZER

[76] Inventor: Ellis Walker, Jr., 8947 Tamar Dr., Apt. 302, Columbia, Md. 21045

[21] Appl. No.: 91,573

[22] Filed: Nov. 5, 1979

[51] Int. Cl.[3] ..... A45C 11/34; B65D 81/36; B65D 85/00

[52] U.S. Cl. ..... 206/214; 206/371; 220/4 D; 220/335; 248/447; 248/460

[58] Field of Search ..... 206/214, 45.11, 45.2, 206/216, 371; 220/4 D, 335; 217/60 R; 248/447, 450, 460

[56] References Cited

U.S. PATENT DOCUMENTS

| | | | |
|---|---|---|---|
| 1,321,363 | 11/1919 | Chipman | 248/450 |
| 2,449,492 | 9/1948 | Long | 248/447 |
| 3,305,205 | 2/1967 | Frankl | 206/45.2 |
| 4,044,980 | 8/1977 | Cummins | 248/460 |

FOREIGN PATENT DOCUMENTS

| | | | |
|---|---|---|---|
| 76808 | 9/1948 | Czechoslovakia | 206/214 |

*Primary Examiner*—William T. Dixson, Jr.
*Attorney, Agent, or Firm*—Breneman, Kane & Georges

[57] ABSTRACT

A compact three-leaf combination book prop and notepad. The three leaves are hinged end-to-end and fold closed in a flat "Z" orientation so as to be suitable for insertion in a breast pocket. Two of the leaves may be fixed in an inverted "V" orientation to give vertical support to a book. The third leaf includes a paper pad clip which also serves as a book catch for preventing horizontal slippage of the propped book. The front face of the center leaf includes a thin electronic computer and a holder for a flattened writing utensil.

21 Claims, 4 Drawing Figures

COLLAPSIBLE BOOK SUPPORT AND ORGANIZER

BACKGROUND OF THE INVENTION

The present invention relates to multipurpose pocket size fold-up devices. In particular the device relates to a hinged three-leaf device which is foldable into a book prop and notepad and for other uses.

Prior book props have been of designs which do not adapt themselves to multiple use and to being folded up into a size which permits them to be carried in a breast pocket. For example, book props of conventional design are shown in U.S. Pat. Nos. 4,105,182, 2,080,591, and 1,923,351. One reason that book props have not been widely used heretofore is that they are not easily carried from place-to-place without the use of a carrying case or the like as they are too bulky to be carried in a pocket or pocket book; another is that they are separate items so that other items to be used therewith must be carried separately.

Accordingly, it is a principal purpose of the present invention to provide a compact pocket size device which may be opened to a book prop and may also be utilized for a multitude of associated other purposes.

SUMMARY OF THE INVENTION

The device of the present invention includes three rectangularly shaped rigid leaves which are hingedly connected end-to-end so that they may be folded flat in a "Z" configuration. The device folds out into a combination book prop, and notepad and may also serve one or more other functions. Two of the hinged leaves may be releasably fixed in an inverted "V" orientation as by a latch so as to serve as the vertical support of the book prop. In this orientation, the third leaf, which may be extended horizontally from the base of the central leaf includes a clip for pad of paper. The back side of the clip serves as a horizontal support holding the base of the book against the upright central leaf. The width of horizontal support provided by the central leaf may be extended with slide members which slide horizontally to the sides from within the central leaf. In one embodiment of the invention, a wafer-thin electronic calculator is mounted into the front face of the central leaf beneath the slide members, and to the side of the calculator, a holder for a flat combination pen/pencil is provided.

By the provision of each of these features in a single compact device, the present invention provides several advantages which permit a number of time saving conveniences not available in prior devices. For example, when the invention is being utilized as a book prop, a notepad is conveniently located in front of the book for notetaking using a writing utensil which is also carried by the invention. When the electronic calculator of the invention is being used, it may be propped up for convenient viewing the pad and writing utensil are available for notetaking. By providing all of these features in a single compact device which may be small enough to be inserted in a breast pocket, the inconvenience of carrying a separate pen, calculator, book prop and notepad are avoided.

Other features of the invention include an alphabetized directory printed on at least one rear surface of the device and two flexible flaps fixed to another one of the rear surfaces so that the device can also serve the function of a wallet for carrying money or other miscellaneous items.

BRIEF DESCRIPTION OF THE DRAWINGS

Still further aspects of the present invention are best understood from the following detailed description of the preferred embodiment of the invention when taken with the drawings in which.

DETAILED DESCRIPTION OF THE PREFERRED EMBODIMENT

Figure 1:
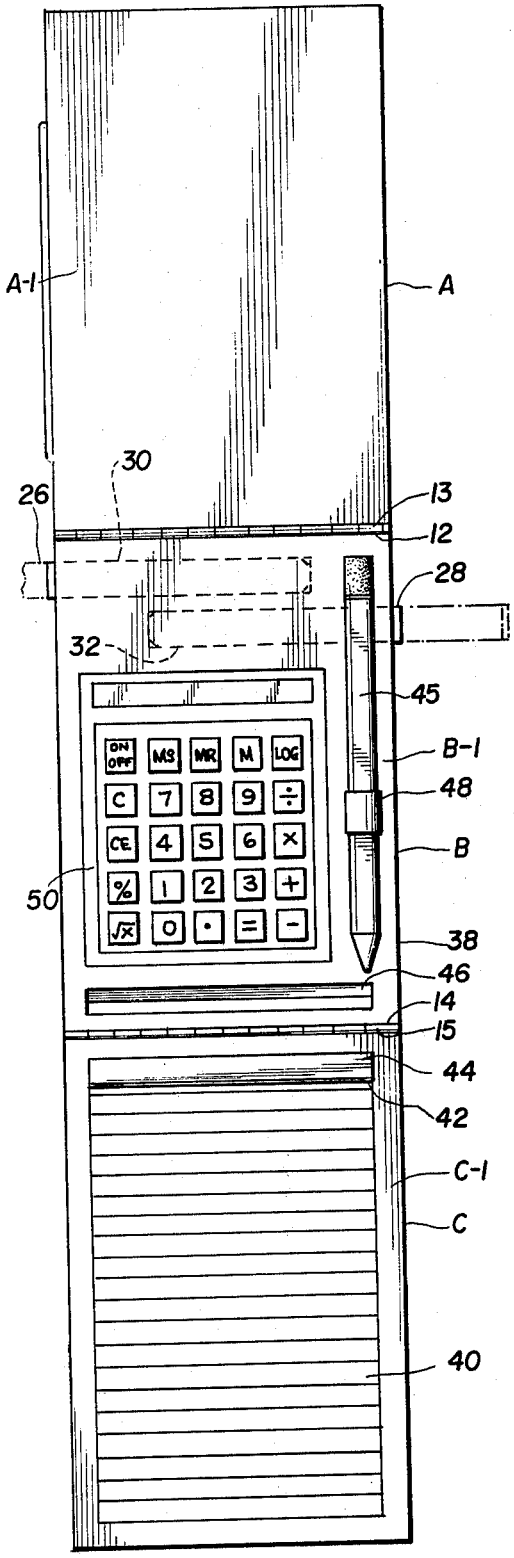
FIG. 1 is a plan view of the front side of the invention.
Figure 2:
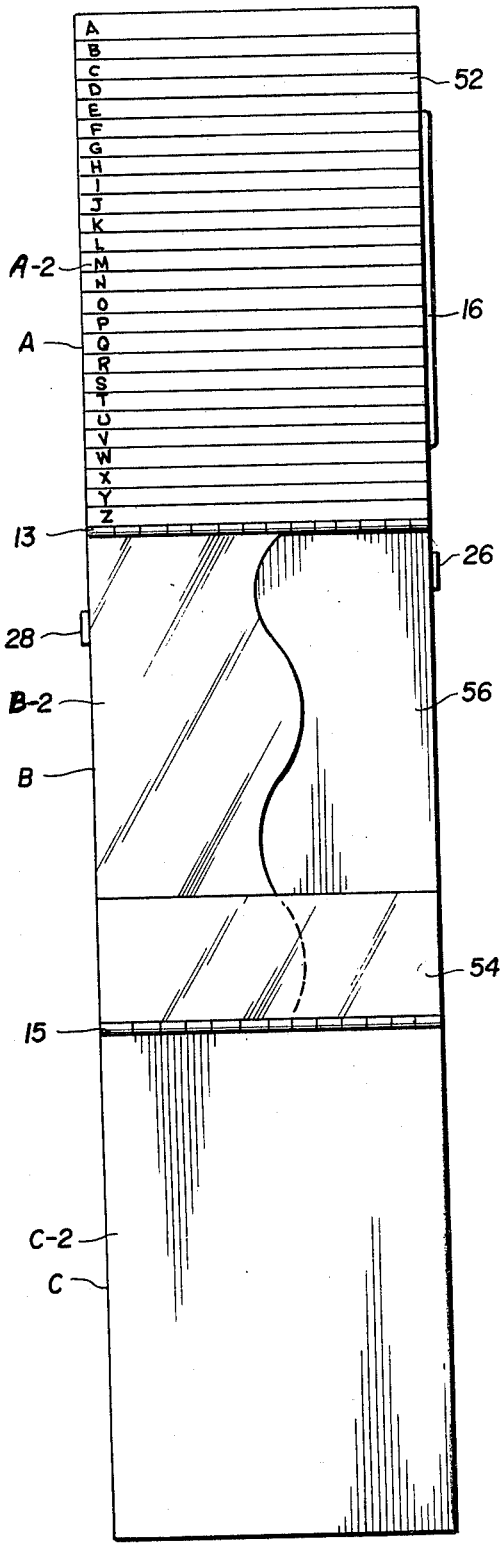
FIG. 2 is a plan view of the rear side of the invention.
Figure 3:
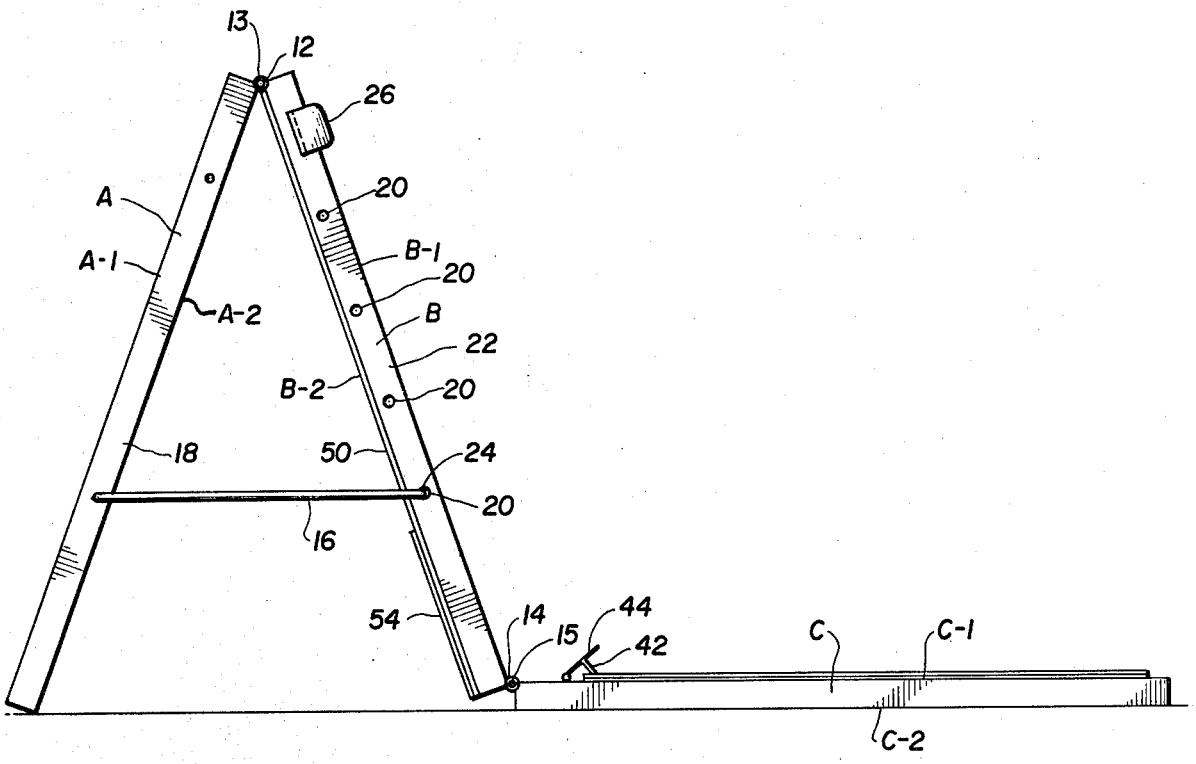
FIG. 3 is a side elevation of the present invention set up for use as a book prop.
Figure 4:
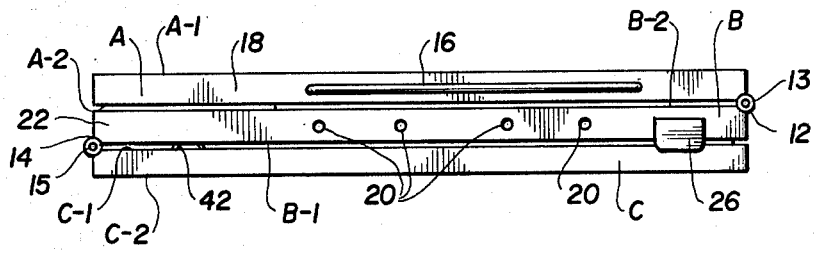
FIG. 4 is a side elevation of the present invention folded up in a "Z" orientation.

Referring now to FIG. 1, there is shown a top plan view of an exemplary embodiment of the present invention. The device includes three rectangular leaves A, B and C, respectively, hingedly connected end-to-end at the top and bottom edges 12 and 14 of rectangular leaf B. The top surfaces of leaves A, B and C will hereinafter be identified by A-1, B-1 and C-1; the corresponding rear surfaces will be identified by A-2, B-2 and C-2, respectively. Leaves A, B and C are suitably composed of tin, aluminum or plexiglass. Hinges 13 and 15, respectively at edges 12 and 14 permit the leaves A, B and C to fold flat against one another in a "Z" orientation, as illustrated in FIG. 4, and also to open into a single plane, as illustrated in FIG. 1. In order to be used as a book prop, leaves A and B are folded into an inverted "V" orientation with the C leaf laying flat on a horizontal surface with its C-1 surface facing upward as illustrated in FIG. 3. Referring to FIG. 3, in order to fix the A and B leaves in the inverted "V" orientation, a catch rod 16, pivotally connected to A leaf side surface 18 has a free end 24 which may be inserted into one of catch rod receiving holes 20 formed in B leaf side surface 22. Catch rod receiving holes 20 permit the A and B leaves to be fixed at a number of different heights. In some alternate embodiments of the invention, catch rod 16 may be replaced by any one of a number of adjustable or nonadjustable latch devices. However, in still other embodiments of the invention, the latch device does not completely rigidize the A and B leaves but merely prevent their collapsing from the inverted "V" orientation shown in FIG. 3.

Referring again to FIG. 1, in order to support an open book against the B-2 surface or the B leaf, elongated planar extension members 26 and 28 are respectively slidably mounted to the B leaf at the upper end thereof in elongated slots 30 and 32 so as to respectively open at opposite side surfaces 22 and 38 of the B leaf. Note pad 40 is secured to front face C-1 of leaf C by a spring clip 42 mounted to leaf C adjacent to hinge 15. A book catch 44, which may be formed integrally with the clip 42, is also mounted to leaf C adjacent to hinge 15. Book catch 44 extends sufficiently across leaf C and vertically upward therefrom so as to catch the bindings of books placed against surface B-1 and prevent the supported book from sliding horizontally on leaf surface C-1. In accordance with one use of the device, a person may read a book propped against the C-1 surface while taking notes on the pad 40 which is secured to the A-1 surface by clip 42. A slot 46 is formed in the B-1 surface of leaf B for receiving clip 42 and book catch 44 when the device is folded into its closed "Z" position, thus permitting the B-1 and C-1 surfaces to lie flush against one another when the device is closed.

In accordance with the preferred embodiment of the present invention, calculator 50 is mounted within leaf B with its front face exposed at the B-1 surface between extender 28 and slot 46. The calculator is preferably very thin, e.g., $\frac{1}{3}$-inch, since it is desirable that the total thickness of the device when in its folded-up condition be no more than $\frac{3}{4}$ to 1 inch. By adjusting catch rod 16, the inclination of the calculator may be adjusted to suit the user. Again, the notepad is conveniently located to jot down calculations made with the calculator. In order to complete the package necessary for note taking when either the calculator or book prop functions of the leaf are being utilized, a flat pen or pencil or dual purpose pen-pencil writing utensil 45 may be retained against the B-1 surface by loop holder 48 mounted to leaf B adjacent to calculator 50.

The remaining surfaces of the device may also be functionally utilized. For example, the A-2 and B-2 surfaces may be utilized for holding small objects and/or displaying imprinted information. In the present embodiment, surface A-2 is a writing surface 52 on which indicia of an alphabetized directory are imprinted. On the B-2 surface, wallet flaps 54 and 56 are fixed for holding money or other small objects. The C-1 surface upon which paper pad 40 is disposed, could have any useful printed matter disposed thereon as for example, a metric equivalence table. Although surfaces A-1 and C-2 could also be functionally utilized, the preferred embodiment includes a vinyl or other protective covering since the surfaces are exposed when the device is in a folded-up condition.

Although only one exemplary embodiment of this invention has been described in detail above, those skilled in the art will readily appreciate that many modifications are possible in the exemplary embodiment without materially departing from the novel teaching and advantages of this invention. Accordingly, all such modifications are intended to be included within the scope of this invention as defined in the following claims. For example, if desired, the device may be provided with snaps or other simple means for holding the leaves in their folded-up position.

What is claimed is:

1. A reversible hinged collapsible book support and organizer device comprising:

first, second and third leaves, pivotally connected end-to-end along transverse edges said second leaf being respectively pivotally connected at opposite ends thereof to said first and third leaves, said leaves having front surfaces and rear surfaces, all of said front surfaces facing in the same direction when said device is laid flat on a plane surface and which folds to a flat configuration wherein said front side of said first leaf and said second side of said third leaf provides a front and back cover for said device;

means for releasably holding said first leaf relative to said second leaf in an inverted "V"-shaped orientation with said front surfaces facing upward so that said second leaf front surface may serve as a vertical support for a book; and means for fastening note paper to the front surface of said third leaf;

said notepad fastening means including means for horizontally supporting said book when said book is propped against second leaf front surface.

2. Device as in claim 1 wherein said fastening means for said note paper comprises a clip.

3. Device as in claim 1 further comprising means, fastened to said second leaf front surface, for holding a writing utensil.

4. Device as in claim 1 wherein said releasably holding means comprises means, hingedly mounted to at least one of said first and second leaves, for connecting to the other of said first and second leaves.

5. Device as in claim 1 wherein said second leaf comprises wafer-thin electronic calculator.

6. Device as in claim 3 further comprising a flattened writing utensil insertable in said holding means so that said device may be closed flat.

7. Device as in claim 1 wherein said second leaf has first and second longitudinal side edges perpendicular said transverse edges and said second leaf further comprises means, slidable parallel to said transverse edges between a first position between said first and second side edges and a second position outside said first and second side edges, for supporting a book opened thereagainst when said means are in said first position.

8. Device as in claim 1 or claim 2 wherein said second leaf front surface has an indentation formed therein which receives said fastening means when said device is folded flat.

9. A hinged device as in claim 1 wherein said first and second leaf front and rear surfaces are rectangularly shaped and have approximately equal dimensions.

10. A hinged device as in claim 9 further comprising at least one flap fixed to at least two adjacent edges of one of the surfaces in a group of surfaces consisting of said first, second and third leaf rear surfaces and said first leaf front surface.

11. A hinged device as in claim 10 wherein said at least one flap comprises two overlapping flaps each fixed to three edges of one of said first and second rear surfaces.

12. A hinged device as in claim 9 wherein said third leaf front and rear surfaces have substantially the same dimensions as have said first leaf and second leaf front and rear surfaces.

13. A reversible hinged collapsible book support and organizer device comprising first, second and third leaves hingedly connected end-to-end, each leaf having a front and a rear surface; said second leaf having a parallel first and second transverse edges; said first leaf being hingedly connected to said second leaf along said first transverse edge such that said first leaf front surface may be folded onto said second leaf rear surface, said third leaf being hingedly connected to said second leaf along said second transverse edge such that said third leaf front surface may be folded onto said second leaf front surface to form a flat configuration wherein said front side of said first leaf and said second side of said third leaf provides a front and back cover for said device;

means, for releasably fixing said first and second leaves in an inverted "V" orientation, said means including a first member hingedly mounted to one of said first and second leaves and releasably connectable to the other of said first and second leaves;

means, mounted to said third leaf, for fixing a pad of paper thereto;

means, mounted to said third leaf and extending substantially vertically therefrom adjacent said second hinge, for horizontally supporting a book resting against said second leaf front surface when said first and second leaves are fixed in said inverted "V" orientation and said third leaf is in a horizontal orientation.

14. A device as in claim 13 wherein said pad fixing means comprises a clip fixed to said third leaf adjacent to and integral with said horizontally supporting means.

15. A device as in claim 1 wherein said first leaf comprises a lower edge parallel said second leaf first edge, which folds against said second leaf second edge when said first and second leaves are folded together; and said third leaf comprises a lower edge parallel said second leaf second edge which folds against said second leaf first edge when said first and third leaves are folded together.

16. A device as in claim 14 wherein said first leaf has a groove formed in the front surface thereof adjacent said second leaf first edge for receiving said clip and horizontally supporting means when said first and second leaves are folded together.

17. Device as in claim 13 wherein said second leaf includes a wafer-thin electronic calculator disposed at said second leaf front surface.

18. Device as in claim 17 further comprising a flattened writing utensil removably held to said second leaf front surface adjacent said calculator.

19. Device as in claim 13 wherein said first, second and third leaf rear surfaces have at least one writing surface, indicia being disposed thereon corresponding to a directory, there being space thereon for writing names, addresses and telephone numbers.

20. A device as in claim 15 further comprising at least one transparent flap fixed to one of the said first, second and third leaves.

21. A device as in claim 1 or claim 13 wherein the surfaces of each of said first, second and third leaves have widths of no more than 4 inches and lengths no more than 7 inches, and the combined thickness of said first, second and third leaves when in said folded-up position is less than 1 inch.

* * * * *